US008042333B2

(12) United States Patent
Friesen

(10) Patent No.: US 8,042,333 B2
(45) Date of Patent: Oct. 25, 2011

(54) OIL COOLING CIRCUIT FOR CONTINUOUSLY RECIPROCATING HYDRAULIC CYLINDERS

(75) Inventor: Randall Friesen, Great Bend, KS (US)

(73) Assignee: Hampton Hydraulics, Hampton, IA (US)

( * ) Notice: Subject to any disclaimer, the term of this patent is extended or adjusted under 35 U.S.C. 154(b) by 598 days.

(21) Appl. No.: 12/048,640

(22) Filed: Mar. 14, 2008

(65) Prior Publication Data

US 2008/0223029 A1 Sep. 18, 2008

Related U.S. Application Data

(60) Provisional application No. 60/906,988, filed on Mar. 14, 2007.

(51) Int. Cl.
*F15B 21/04* (2006.01)
*E02F 9/22* (2006.01)

(52) U.S. Cl. ..... 60/456; 60/484

(58) Field of Classification Search ..... 60/453, 60/456, 484

See application file for complete search history.

(56) References Cited

U.S. PATENT DOCUMENTS

| | | | | |
|---|---|---|---|---|
| 4,249,376 | A * | 2/1981 | Weckerly | 60/456 |
| 5,072,584 | A * | 12/1991 | Mauch et al. | 60/378 |
| 6,672,056 | B2 * | 1/2004 | Roth et al. | 60/456 |
| 2005/0229594 | A1 * | 10/2005 | Nanjo et al. | 60/484 |

FOREIGN PATENT DOCUMENTS

JP 2005155698 A * 6/2005

* cited by examiner

*Primary Examiner* — Thomas E Lazo

(74) *Attorney, Agent, or Firm* — Kent A. Herink; Emily E. Harris

(57) ABSTRACT

An oil cooling and filtering circuit connecting a reciprocating fluid power hydraulic cylinder to a reversible hydraulic pump or hydraulic directional valve. The circuit consists preferably of a three-way, three-position valve and a purge relief valve, which functions to divert a percentage of the low pressure oil coming out of the cylinder work port to an oil cooler. Instead of the fluid simply moving back and forth in the line and become overheated due to fluid friction and repeated pressurization, the working fluid in the line to the cylinder work port is circulated out of the fluid line and gradually replaced with cooled oil. The circuit itself does not perform cooling, but it provides a means to send trapped oil to an oil cooler. A secondary advantage is to provide filtration to the oil that is removed for cooling.

1 Claim, 4 Drawing Sheets

OIL COOLING CIRCUIT FOR CONTINUOUSLY RECIPROCATING HYDRAULIC CYLINDERS

This application claims priority to U.S. Patent Application Ser. No. 60/906,988, filed Mar. 14, 2007.

BACKGROUND OF THE INVENTION

The invention relates generally to hydraulic circuitry and, more specifically, to an oil cooling circuit for continuously reciprocating hydraulic cylinders.

Hydraulic cylinders are used in a wide variety of applications. In certain applications, particularly high pressure, high duty applications, the hydraulic fluid may reach temperatures that begin to degrade components of the hydraulic circuitry and adversely affect performance of the hydraulic cylinders and associated equipment. In particular, some continuously reciprocating high-pressure cylinders currently experience higher than normal rod seal failure. Because these systems have high costs of construction and operation, repair and replacement of components as a result of heat damage is expensive not only in the cost of replacement components and the labor required for the repair but also in the downtime of the equipment.

Hydraulic fluid builds up heat if it is doing work but is not able to travel out to an oil cooler. Heat buildup is due to fluid friction and the thermodynamic effect (adiabatic heating) of being repeatedly compressed during each cylinder cycle. Depending on the displacement of the cylinder and the length and diameter of the fluid lines that power the cylinder, a certain percentage of this oil is trapped and merely travels back and forth in the fluid lines connected to the work ports of the cylinder. Hydraulic oil has a compressibility of approximately 0.5 percent per 1000 psi of pressure. If the hose or tubing carrying the high pressure oil from the pump to the cylinder has sufficient length that a significant percentage of the oil volume required for that stroke never leaves the hose or tubing, this trapped oil cannot circulate out for cooling and heat builds up incrementally during operation. A certain amount of mixing and heat transfer with cooler, in-coming oil most likely occurs but the oil closest to the cylinder piston remains at a high temperature and in an unfiltered condition. As the linear distance between the pump or valve and the cylinder is increased, and as the cylinder displacement is increased, the problem becomes more severe.

There is a need, accordingly, for a means of cooling the hydraulic fluid in such systems to avoid the high temperatures that adversely affect performance, the cost of operation, and the costs of repairs.

SUMMARY OF THE INVENTION

The present invention provides a solution to the main problem of heat generated in the hydraulic fluid that is trapped in the fluid line between the pump or valve and the cylinder work port, and to the secondary problems of lack of filtration of this fluid and of breakdown of the anti-wear properties of the fluid due to overheating. The invention provides a means to move this trapped oil out of the lines and be circulated so that it can be cooled using other standard cooling methods currently in use in hydraulic systems. The invention is particularly useful for high pressure, from about 3,000 to about 5,000 psi, continuously reciprocating hydraulic cylinders, such as those used for pumping petroleum-based fluids and mud for drilling oil wells.

DETAILED DESCRIPTION OF PREFERRED EMBODIMENTS

Figure 1:
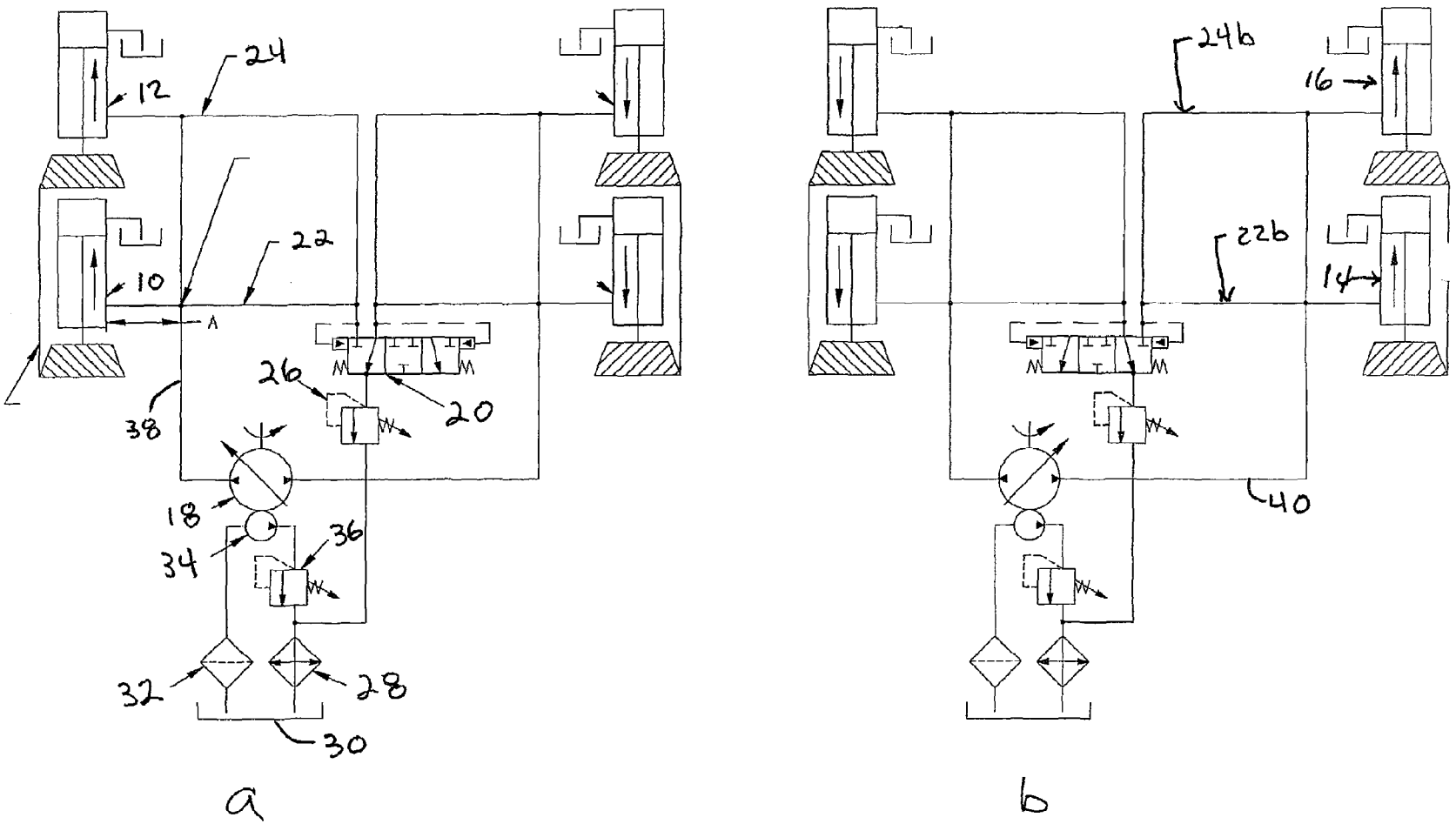
FIGS. 1*a* and 1*b* are schematic diagrams of two sets of single acting hydraulic cylinders wherein the first set of cylinders is at high working pressure and the second set of cylinders is at low pressure (a), and wherein second set of cylinders is at high working pressure and the first set of cylinders is at low pressure (b).

Illustrated in FIGS. 1*a* and 1*b* are two sets of single acting cylinders, the first set comprising cylinders 10 and 12 and the second set comprising cylinders 14 and 16. The cylinders 10-16 are in close proximity and are driven by opposite ports of a reversible closed-loop hydraulic pump 18. While in the preferred embodiment shown in FIGS. 1*a* and 1*b* there are two single acting cylinders working in parallel on the two sides of the hydraulic pump 18, there may also be only a single cylinder or more than two cylinders acting in parallel on the two sides of the hydraulic pump 18. When the first set of cylinders 10 and 12 is at high working pressure, the second set of cylinders 14 and 16 is at low pressure. The supply of hydraulic fluid to the cylinders 10-16 is controlled by a three-position, three-way valve 20. Some of the hydraulic fluid from the first set of cylinders 10 and 12 is allowed to travel through the first and second purge lines 22 and 24 of the cylinders 10 and 12, respectively, via one side of the valve 20, through a purge relief valve 26 and then to a heat exchanger or oil cooler 28. The cooled fluid is then returned to a fluid reservoir 30. The removed oil or hydraulic fluid is cooled and may also filtered by filter 32 as it is pumped back through the circuit.

A charge pump 34 supplies fluid to the pump 18 and a charge pressure relief valve 36 is interposed between the charge pump 34 and the cooler 28. Elements 18, 34 and 36 comprise a hydrostatic pump unit. The movement of fluid going through the purge lines 22 and 24 is allowed by setting the purge relief valve 26 pressure approximately 100 psi lower than the setting of the charge pump relief valve 36, and the percentage of oil that travels this route is determined by the pressure differential between those two valves.

The condition of the components of FIG. 1*a* wherein the working high pressure is supplied to the cylinders 14 and 16 is illustrated in FIG. 1*b*, with the purge lines indicated at 22*b* and 24*b*, respectively.

It is important that the connection between the line 38 from the pump 18 to each of the cylinders 10 and 12, and the corresponding line 40 from the pump 18 to each of the cylinders 14 and 16, be integral with the port of each of the corresponding hydraulic cylinders, or attached close to it, so that distance is small, approximately one to five inches, and further that there is a purge line thus connected to each cylinder in the each of the set of cylinders. If only one purge line is used for either set, and if the distance to the purge line connection is too long, the volume of oil in this length of line becomes trapped and is not circulated out for cooling and filtering.

Figure 2:
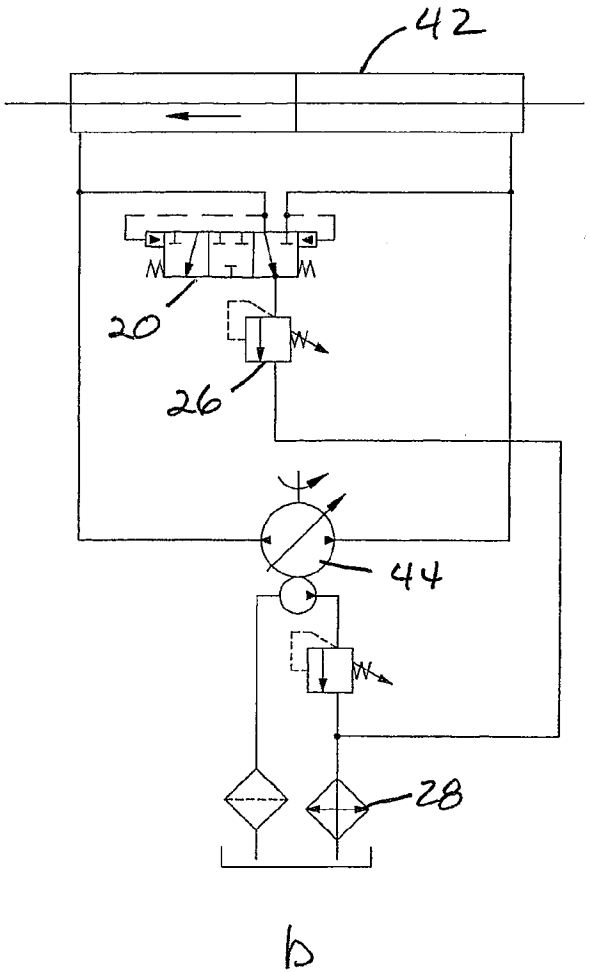
FIGS. 2*a* and 2*b* are schematic diagrams of a double acting cylinder driven by a closed loop hydrostatic pump wherein first one side of the cylinder is supplied with pressurized fluid (a) and then the second side is supplied with pressurized fluid (b).
Figure 2:
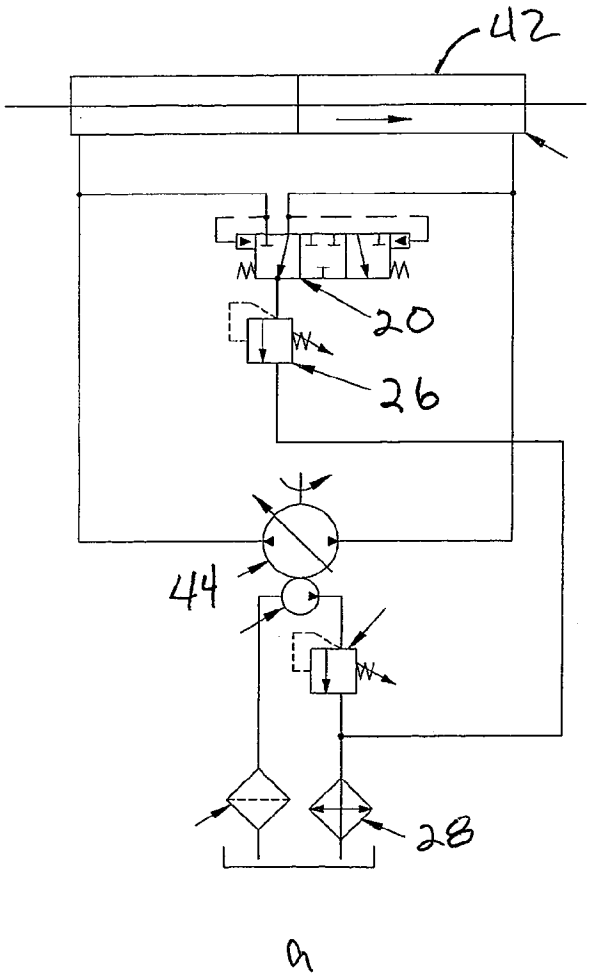

FIGS. 2*a* and 2*b* show an alternative preferred embodiment of a cooling circuit of the present invention wherein a double acting double rod cylinder 42 is driven by a closed loop hydrostatic pump 44. When one side of the cylinder 42 is under load at high pressure, the other side is at lower pressure and the three position three way valve 20 allows oil from the low pressure side to travel through the purge relief valve 26 and oil cooler 28, the purge oil flow rate being determined the same as in FIGS. 1*a* and 1*b*.

Figure 3:
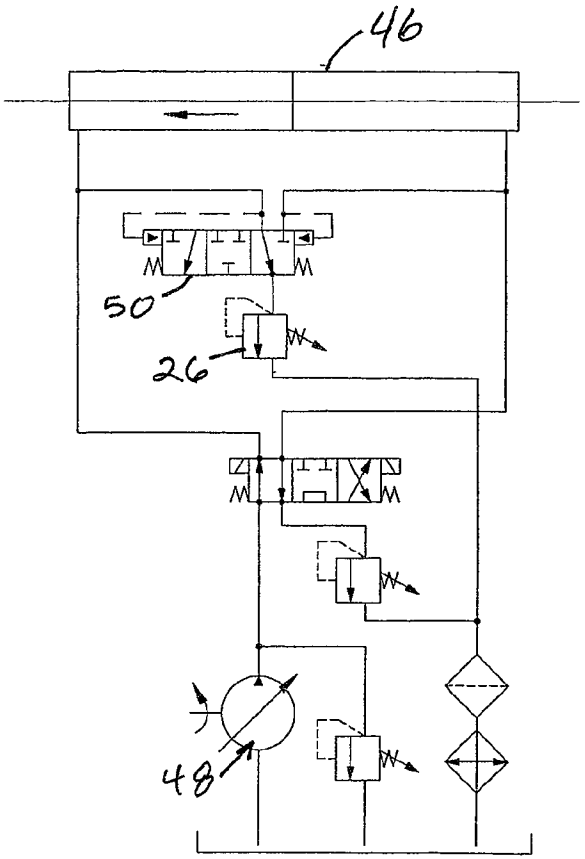
FIGS. 3*a* and 3*b* are schematic diagrams corresponding to FIGS. 2*a* and 2*b* except that an open loop hydraulic pump is used to drive the cylinder.
Figure 3:
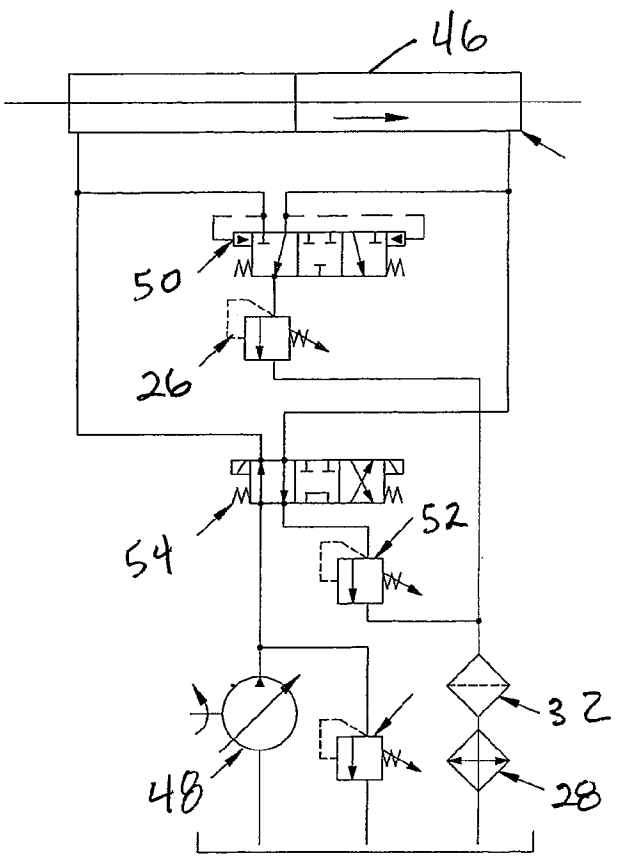

FIGS. 3*a* and 3*b* show another alternative embodiment of the present invention. A double acting double rod cylinder 46 is driven by an open loop hydraulic pump 48 and a four-way, three-position directional valve 50. In this case an additional purge relief valve 52 is added between the directional valve 50 and the oil filter 32, so that a pressure differential can be controlled which will determine the percentage of oil that travels through the purge relief valve 54. Valve 54 would be set approximately 100 psi higher than valve 52 to create this pressure differential.

Figure 4:
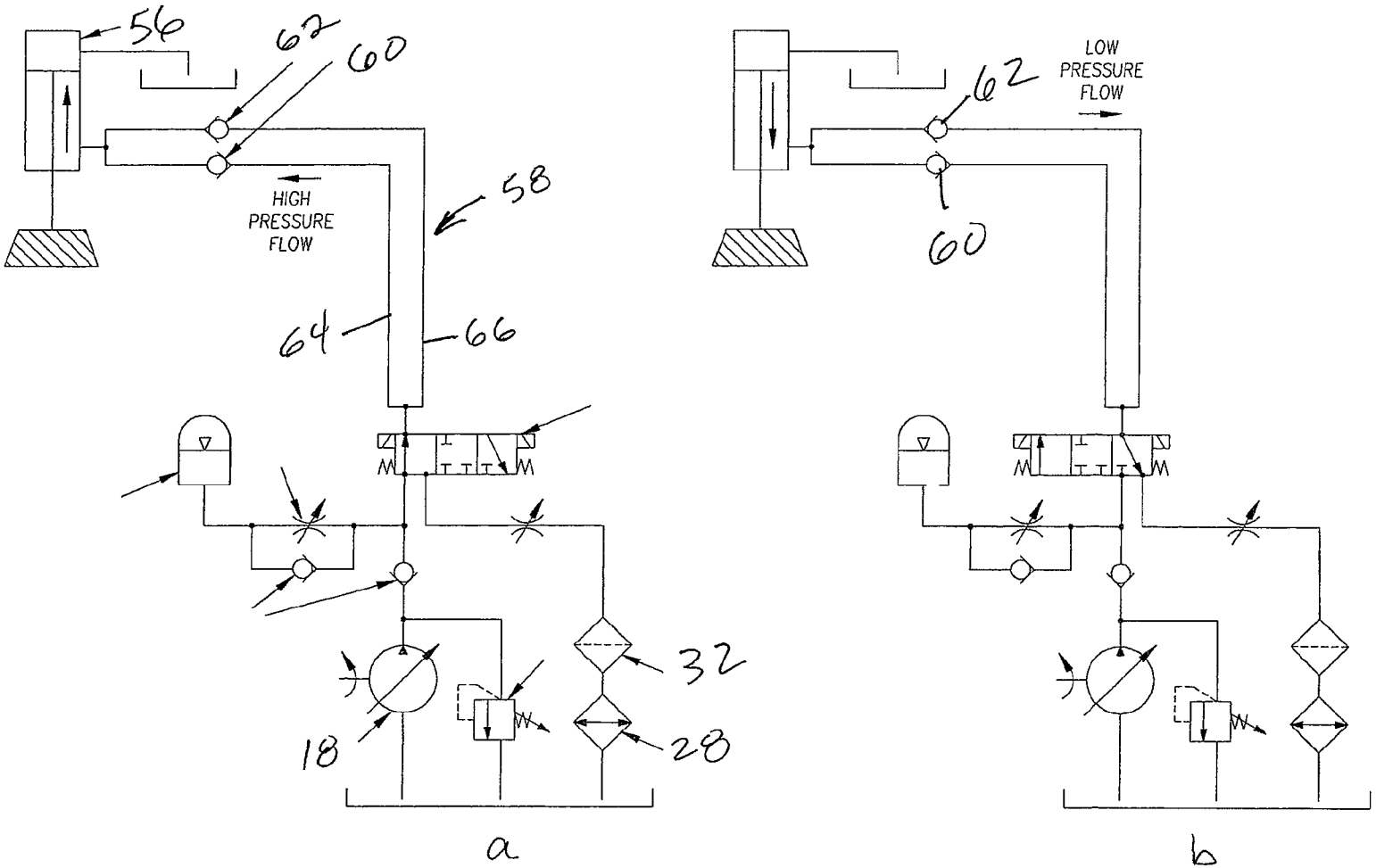
FIGS. 4*a* and 4*b* are schematic diagrams of an alternative embodiment wherein a single acting cylinder is connected to a hydraulic pump through ingress and egress check valves.

FIGS. 4*a* and 4*b* show still another alternative embodiment of the present invention employing a single acting cylinder 56 supplied with pressurized hydraulic fluid through a supply line 58. Due to the length of the supply line 58, there is a volume of oil in the supply line 58 that is larger than the displacement of the cylinder 56, and thus a significant portion of the oil is trapped in supply line 58 and is not circulated out for cooling or filtering. Trapped oil from the cylinder 56 is removed by the action of an egress check valve 62 and ingress check valve 60 in two parallel supply lines 64 and 66, respectively. The present invention thus replaces the conventional single line connecting the hydraulic cylinder work port to the pump or valve with two parallel lines that are connected to the work port through egress and ingress check valves and parallel work port lines connected to them. The check valves 60 and 62 are connected close to the work port of the cylinder 56, preferably from between one to five inches, so that the maximum amount of fluid in the work port line can be circulated out for cooling and filtering.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

I claim:

1. A fluid cooling circuit for continuously reciprocating hydraulic cylinders, comprising:

(a) a pump for supplying pressurized hydraulic fluid;

(b) a continuously reciprocating hydraulic cylinder operated by fluid from the pump;

(c) hydraulic circuitry for controlling hydrostatic pressure to extend and retract the hydraulic cylinder;

(d) a cooler for cooling fluid from the hydraulic cylinder;

(e) a pair of parallel hydraulic lines interconnecting the pump and the hydraulic cylinder; and (f) an egress check valve in a first one of the parallel lines and an ingress check valve in the second parallel line to direct at least a portion of the hydraulic fluid from the hydraulic cylinder to the cooler.

* * * * *